US012753941B2

(12) United States Patent
Fux et al.

(10) Patent No.: US 12,753,941 B2
(45) Date of Patent: Oct. 6, 2026

(54) METHOD, CONTROLLER AND SYSTEM OF CONTROLLING THERMAL POWER TRANSFER THROUGH A THERMAL ENERGY EXCHANGER

(71) Applicant: BELIMO Holding AG, Hinwil (CH)

(72) Inventors: Samuel Fux, Uster (CH); Stefan Mischler, Wald (CH); Peter Schmidlin, Uster (CH); Marc Thuillard, Uetikon am See (CH); Valentin Gresch, Pfäffikon (CH); Philip Holoch, Neschwil (CH); Wiliam Zogg, Egg (CH)

(73) Assignee: BELIMO Holding AG, Hinwil (CH)

( * ) Notice: Subject to any disclaimer, the term of this patent is extended or adjusted under 35 U.S.C. 154(b) by 452 days.

(21) Appl. No.: 18/036,686

(22) PCT Filed: Nov. 11, 2021

(86) PCT No.: PCT/EP2021/081362
§ 371 (c)(1),
(2) Date: May 12, 2023

(87) PCT Pub. No.: WO2022/135785
PCT Pub. Date: Jun. 30, 2022

(65) Prior Publication Data

US 2023/0417443 A1 Dec. 28, 2023

(30) Foreign Application Priority Data

Dec. 22, 2020 (CH) ..... 01653/20

(51) Int. Cl.
*F28F 27/00* (2006.01)
*F24F 11/64* (2018.01)
(Continued)

(52) U.S. Cl.
CPC ..... *F24F 11/64* (2018.01); *F24F 11/84* (2018.01); *F24F 11/85* (2018.01); *F28F 27/00* (2013.01);
(Continued)

(58) Field of Classification Search
CPC .. F24F 11/64; F24F 11/84; F24F 11/85; F24F 2110/10; F24F 2140/40; F24F 2140/60;
(Continued)

(56) References Cited

U.S. PATENT DOCUMENTS 4,440,507 A * 4/1984 Karras ..... G01K 17/08 374/E17.008
5,600,960 A 2/1997 Schwedler et al.
(Continued)

FOREIGN PATENT DOCUMENTS

CA 3076442 A1 4/2019
CN 102422093 A 4/2012
(Continued)

OTHER PUBLICATIONS

Swiss Search Report for CH16532020 dated Apr. 19, 2021.
(Continued)

*Primary Examiner* — Alicia M. Choi
(74) *Attorney, Agent, or Firm* — Sughrue Mion, PLLC

(57) ABSTRACT

A method of controlling a thermal power transfer of a thermal energy exchanger (80) of an HVAC system (1), the method comprising: receiving, by a controller (10), a setpoint thermal power transfer (Power SP); measuring, by a flow sensor (52), a measured flow of fluid ($\phi_{act}$) through the thermal energy exchanger (80); determining, by the controller (10), an estimated thermal power transfer (Power EST), using the measured flow of fluid ($\phi_{act}$) and a defined flow rate to delta-T mapping; comparing, by the controller (10), the setpoint thermal power transfer (Power SP) and the
(Continued)

estimated thermal power transfer (Power EST); and regulating, by the controller (10), the flow (ϕact) of the fluid (W) through the thermal energy exchanger (80) based on the comparing.

16 Claims, 10 Drawing Sheets

(51) Int. Cl.

| | |
|---|---|
| ***F24F 11/84*** | (2018.01) |
| ***F24F 11/85*** | (2018.01) |
| *F24F 110/10* | (2018.01) |
| *F24F 140/40* | (2018.01) |
| *F24F 140/60* | (2018.01) |
| *F28D 21/00* | (2006.01) |

(52) U.S. Cl.
CPC ..... *F24F 2110/10* (2018.01); *F24F 2140/40* (2018.01); *F24F 2140/60* (2018.01); *F28D 2021/0068* (2013.01)

(58) Field of Classification Search
CPC . F24F 11/83; F24F 11/30; F28F 27/00; F28D 2021/0068; F01K 13/02; F25B 49/02
See application file for complete search history.

(56) References Cited

U.S. PATENT DOCUMENTS

| | | | | |
|---|---|---|---|---|
| 9,366,452 | B2 | 6/2016 | Takenaka et al. | |
| 9,534,807 | B2 | 1/2017 | Takenaka et al. | |
| 9,874,880 | B2 | 1/2018 | Thuillard et al. | |
| 9,964,329 | B2 * | 5/2018 | Whitmore | F16K 27/003 |
| 10,132,417 | B2 * | 11/2018 | Song | F16K 31/124 |
| 12,018,851 | B2 | 6/2024 | Reider | |
| 2011/0301766 | A1 * | 12/2011 | Higgins | G06Q 10/06 700/282 |
| 2012/0042674 | A1 | 2/2012 | Takenaka et al. | |
| 2015/0081086 | A1 * | 3/2015 | Hallowell | F23N 5/003 700/209 |
| 2016/0054741 | A1 | 2/2016 | Thuillard et al. | |
| 2016/0238273 | A1 | 8/2016 | Takenaka et al. | |
| 2018/0195753 | A1 * | 7/2018 | Reider | F24F 11/62 |
| 2019/0063778 | A1 | 2/2019 | Passoni et al. | |
| 2019/0107292 | A1 * | 4/2019 | Mischler | F24D 10/003 |
| 2020/0393160 | A1 * | 12/2020 | Tsouvalas | F24F 11/76 |
| 2021/0148589 | A1 | 5/2021 | Reider | |

FOREIGN PATENT DOCUMENTS

| | | | | |
|---|---|---|---|---|
| CN | 105378575 | A | 3/2016 | |
| CN | 105987486 | A | 10/2016 | |
| CN | 107228455 | A | 10/2017 | |
| CN | 111201500 | A | 5/2020 | |
| CN | 111213013 | A | 5/2020 | |
| EP | 3 438 768 | A1 | 2/2019 | |
| WO | 2014/183868 | A2 | 11/2014 | |
| WO | 2019/020429 | A1 | 1/2019 | |
| WO | WO-2019238631 | A1 * | 12/2019 | F24F 11/83 |

OTHER PUBLICATIONS

International Search Report for PCT/EP2021/081362 dated Mar. 4, 2022 (PCT/ISA/210).
Written Opinion for PCT/EP2021/081362 dated Mar. 4, 2022 (PCT/ISA/237).
Communication issued Nov. 24, 2025 in Chinese Application No. 202180086197.3.

* cited by examiner

METHOD, CONTROLLER AND SYSTEM OF CONTROLLING THERMAL POWER TRANSFER THROUGH A THERMAL ENERGY EXCHANGER

CROSS REFERENCE TO RELATED APPLICATIONS

This application is a National Stage of International Application No. PCT/EP2021/081362 filed Nov. 11, 2021, claiming priority based on Swiss Patent Application No. 01653/20 filed Dec. 22, 2020, the contents of each of which being herein incorporated by reference in their entireties.

FIELD OF THE INVENTION

The present invention relates to a method of controlling thermal power transfer of a thermal energy exchanger of a Heating, Ventilating and Air Conditioning HVAC system. The present invention further relates to a controller controlling a thermal power transfer of a thermal energy exchanger of an HVAC system. The present invention further relates to a computer program product comprising instructions, which, when executed by a processor of a controller control a thermal power transfer of a thermal energy exchanger of an HVAC system.

BACKGROUND OF THE INVENTION

By regulating the flow of fluid through a thermal energy exchanger of an HVAC system, it is possible to adjust the amount of energy (respectively the amount of energy per unit of time, power) transferred by the thermal energy exchanger. For example, the energy exchange or the power transfer, correspondingly, is adjusted by regulating the amount of energy delivered by the thermal energy exchanger to heat or cool a room in a building, or by regulating the amount of energy drawn by a chiller for cooling purposes. While the fluid transport through the fluid circuit of the HVAC system is driven by one or more pumps or fans, the flow is typically regulated by varying the orifice (opening) or position of valves, e.g. manually or by way of actuators.

The actual power transfer characteristics of thermal energy exchangers in an HVAC system depend on various environmental conditions such as temperature, humidity, etc. In stable/static scenarios, calculating of the power transfer $Q \approx \phi \cdot \Delta T$ is sufficiently accurate for controlling the power transfer. However, in an HVAC system with numerous transient events and processes, e.g. frequently changing flow rates and temperature differentials $\Delta T$, this basic calculation of power transfer $Q \approx \phi \cdot \Delta T$ alone is often not sufficient for accurate control of power transfer.

According to a known method respectively control system for controlling energy transfer of a thermal energy exchanger of an HVAC system with numerous transient events and processes, a flow sensor measures the flow of fluid through the thermal energy exchanger, a first temperature sensor measures a supply temperature to a thermal energy exchanger, and a second temperature sensor measures a return temperature from the thermal energy exchanger. A control system determines flow-dependent model parameters for modelling performance of the thermal energy exchanger, using one or more measurement data sets, whereby each measurement data set includes for a respective measurement time a value of the measured flow of fluid, a value of the measured supply temperature of the fluid, and a value of the measured return temperature of the fluid.

Using the flow-dependent model parameters, the control system calculates an estimated energy transfer of the thermal energy exchanger, and controls the energy transfer of the thermal energy exchanger by regulating the flow of fluid through the thermal energy exchanger, using the estimated energy transfer.

However, this solution requires several sensors to measure environmental variables, in particular at least a temperature sensor for the measurement of the supply temperature to a thermal energy exchanger, and a second temperature sensor for the measurement of the return temperature from the thermal energy exchanger.

SUMMARY OF THE INVENTION

It is an object of this invention to provide a method and a control system for controlling power transfer of a thermal energy exchanger of an HVAC system, which method and control system do not have at least some of the disadvantages of the prior art.

In particular, it is an object of the present invention to provide a method and a control system for controlling power transfer of a thermal energy exchanger of an HVAC system in dynamic environmental conditions with a reduced need for sensors.

According to the present invention, these objectives are addressed by a method of controlling a thermal power transfer of a thermal energy exchanger of an HVAC system. In a first step of the method according to the present invention, a setpoint thermal power transfer is received by a controller. In a further—subsequent or simultaneous step, a flow of fluid through the thermal energy exchanger at a current position of a valve of the HVAC system arranged for regulating a flow of a fluid through the thermal energy exchanger is measured by a flow sensor. Using the measured flow of fluid, the controller determines an estimated thermal power transfer based on a defined flow rate to delta-T mapping.

In particular, the flow rate to delta-T mapping is defined as a relation between a flow rate of fluid through the thermal energy exchanger and a temperature differential over the thermal energy exchanger. According to embodiments of the present disclosure, the flow rate to delta-T mapping is defined based on calculations, and/or mathematical models and/or measurements of flow rates and temperature differentials over thermal energy exchangers. According to embodiments of the present disclosure, the flow rate to delta-T mapping is calibrated and/or repeatedly refined based on measurements of flow rates and temperature differentials over thermal energy exchangers of the HVAC system or other HVAC systems.

Having determined the estimated thermal power transfer, the controller compares the setpoint thermal power transfer and the estimated thermal power transfer.

Thereafter, the controller controls the flow of fluid through the thermal energy exchanger based on the comparing, in particular by generating a control signal based on the comparing in order to thereby control the thermal power transfer of the thermal energy exchanger.

According to a first embodiment of the present disclosure, the controller regulates the flow of the fluid through the thermal energy exchanger by generating a valve control signal for controlling an orifice of a valve of the HVAC system. The valve is arranged in a flow path of the thermal energy exchanger and energy source, e.g. a heating device (furnace, heat pump) or a cooling device (chiller) such as to regulate the flow of a fluid to and/or from the thermal energy exchanger. In particular, the vale is arranged in a fluid transport system for moving a (thermal transfer) fluid, for example a liquid, e.g. water and/or a refrigerant, or a gas, e.g. air, to and from the thermal energy exchanger. The fluid transport system may comprise fluid transport lines (pipes or ducts), for conducting a flow of fluid through the thermal energy exchanger.

According to a further embodiment of the present disclosure, the controller regulates the flow of the fluid through the thermal energy exchanger by generating a pressure control signal for controlling a supply pressure of the fluid. In particular, the supply pressure of the fluid is provided by a pump or fan, for driving and controlling the flow of the fluid through the thermal energy exchanger. Correspondingly, the pressure control signal is generated for controlling a pump or fan, for driving and controlling the flow of the fluid through the thermal energy exchanger. According to embodiments of the present disclosure, the pump or fan is comprised by or connected to the HVAC system.

According to embodiments disclosed herein, the controller controls the thermal power transfer by generating a control signal (valve control signal and/or pressure control signal) based on the comparing such as to minimize the difference between the setpoint thermal power transfer and the estimated thermal power transfer.

According to embodiments of the present disclosure, the flow rate to delta-T mapping is defined based on one or more of:

- A thermal energy transfer characteristic curve of the thermal energy exchanger, wherein the thermal energy transfer characteristic curve indicates the amount of thermal energy transferred by the thermal energy exchanger as a function of the flow of fluid through the thermal energy exchanger.
- A heat transfer coefficient of the thermal energy exchanger, wherein heat transfer coefficient of the thermal energy exchanger is a proportionality value (e.g. W/(m2*K) between a heat flux (e.g. W/m2) and the thermodynamic driving force for the flow of heat (i.e., the temperature difference, $\Delta T$) characteristic to the thermal energy exchanger.
- A thermal conductivity of the thermal energy exchanger, wherein the thermal conductivity of the thermal energy exchanger is a measure of the thermal energy exchanger's ability to conduct heat;
- A flow and/or temperature of a secondary fluid, e.g. air through and/or around the thermal energy exchanger. In particular, according to embodiments of the present disclosure wherein the thermal energy exchanger is arranged in an air duct, the flow of air relates to the flow of air through the air duct in which the thermal energy exchanger is arranged in. According to embodiments of the present disclosure, the flow of air is influenced by a fan configured and arranged to drive air through thermal energy exchanger.
- A convection heat transfer coefficient of the fluid, wherein convection heat transfer coefficient of the fluid is a measure of the fluid's ability to transfer heat by conduction and is characteristic to the particular fluid, in particular as a sum of the fluid's ability to transfer heat by the combined processes of conduction (heat diffusion) and advection (heat transfer by bulk fluid flow).
- A current operation mode of the thermal energy exchanger, wherein the operation modes of the thermal energy exchanger comprise (but not limited to) a cooling operation mode and a heating operation mode. In particular, the flow rate to delta-T mapping is defined based on values characteristic to the particular operation mode of the thermal energy exchanger.
- A thermal energy exchanger type, comprising (but not limited to) a water/water, a water/air or air/air type of thermal energy exchanger. In particular, the flow rate to delta-T mapping is defined based empirical values characteristic of the particular type of thermal energy exchanger.
- Geometric data of the thermal energy exchanger, such as thermal energy exchange surface. In particular, the flow rate to delta-T mapping is defined based values corresponding to/calculated based on geometric data (dimensions) of the thermal energy exchanger.

According to embodiments of the present disclosure, as part of determining the estimated thermal power transfer, the controller determines an estimated temperature differential over the thermal energy exchanger based on the measured flow of the fluid, wherein the controller determines the estimated thermal power transfer based on the measured flow of fluid and the estimated temperature differential.

According to embodiments of the present disclosure, a temperature of a secondary fluid through and/or around the thermal energy exchanger is measured by a temperature sensor. Alternatively, data indicative of the temperature of the secondary fluid is received by the controller (from a data source/sensor external to the HVAC system). The flow rate to delta-T mapping is defined and/or calibrated using the temperature of the secondary fluid.

For example, in a cooling operating mode of the thermal energy exchanger, for an assumed constant supply temperature (e.g. 6° C.) of the fluid, the flow rate to delta-T mapping is determined using extrapolation based on (empirical data):

- a known temperature differential of 6° K at a maximum flow of fluid;
- a known temperature differential essentially identical to the temperature of the secondary fluid (air) at a sufficiently low flow rate of the fluid.

Hence, the thermal power transfer can be estimated precisely even without the need for a temperature sensor of supply temperature or return temperature of the fluid. According to embodiments of the present disclosure, a supply temperature or a return temperature of the fluid is measured by a temperature sensor. Alternatively, data indicative of the supply temperature or return temperature of the fluid is received by the controller (from a data source/sensor external to the HVAC system). Thereafter, the flow rate to delta-T mapping is calibrated using the supply or return temperature of the fluid.

In order to control the orifice of the valve and thereby the flow of fluid through the thermal energy exchanger, embodiments of the present invention further comprise the steps of transmitting, by the controller, the valve control signal to an actuator mechanically coupled to the valve and actuating the valve, by the actuator, in accordance with the valve control signal.

In order to control the supply pressure and thereby the flow of fluid through the thermal energy exchanger, embodiments of the present invention further comprise the steps of transmitting, by the controller, the pressure control signal to a device for driving and controlling the flow of the fluid such as a pump or fan, and controlling the pump or fan in accordance with the pressure control signal.

The above-identified objectives are further addressed according to the present invention by a controller for controlling thermal power transfer of a thermal energy exchanger, the controller comprising a processor configured to carry out the method according to one of the embodiments disclosed herein.

The above-identified objectives are further addressed according to the present invention by an HVAC system comprising: a thermal energy exchanger; a controller communicatively connected to the actuator; and a flow sensor configured for measuring a flow of fluid through the thermal energy exchanger. The controller is configured to: determine an estimated thermal power transfer, using the measured flow of fluid and a defined flow rate to delta-T mapping;

generate a control signal for regulating the flow of the fluid through the thermal energy exchanger based on the comparing According to embodiments of the present disclosure, the HVAC system (1) further comprises a valve (40) having an orifice and an actuator (20) mechanically coupled to the valve (40). The control signal, generated by the controller (10), comprises a valve control signal for controlling an orifice of the valve (40) of the HVAC system (1). The controller (10) is further configured to transmit the valve control signal to the actuator (20), the actuator being configured to actuate the valve controlling the orifice such as to regulate the flow of a fluid through a thermal energy exchanger in accordance with the valve control signal.

According to further embodiments of the present disclosure, the HVAC system further comprises a pump (100) for driving the fluid (W) through the thermal energy exchanger (90). Correspondingly, the control signal, generated by the controller (10), comprises a pressure control signal for controlling a supply pressure of the fluid (W). The controller (10) is further configured to transmit the pressure control signal to the pump (90), the pump (90) being configured drive the fluid (W) through a thermal energy exchanger (80) at a supply pressure in accordance with the pressure control signal.

Known particular application of HVAC systems comprises a 2- or 3-way flow regulator arranged in a flow path of a heat exchanger and fluid source(s), the flow regulator allowing regulating the flow of fluid by actuation between an opened and closed position.

A further known particular application of HVAC systems comprises a 6-way flow regulator arranged between a heat exchanger and a fluid source of a first temperature and a fluid source of a second temperature. In particular, 6-way flow regulators are used in applications when the same heat exchanger is being used for both heating and cooling, the 6-way flow regulator being arranged to switch the heat exchanger's fluid input and return between a first respectively a second fluid circuit. 6-way flow regulators comprise a first fluid input; a second fluid input; a fluid output; a fluid return input; a first fluid return output; and a second fluid return output. Known 6-way flow regulators may be operated in a first operating mode, a second operating mode and a third operating mode. In the first operating mode, the 6-way flow regulator enables a flow of fluid from the first fluid input towards the fluid output and a flow of fluid from the fluid return input towards the first fluid return output. In the second operating mode, the 6-way flow regulator enables a flow of fluid from the second fluid input towards the fluid output and a flow of fluid from the fluid return input towards the second fluid return output. In the third operating mode, the 6-way flow regulator prevents passage of fluid between any of the first fluid input; the second fluid input; the fluid output; the fluid return input; the first fluid return output and the second fluid return output.

It is an object of further embodiments of the present invention to enable an HVAC system comprising a 6-way flow regulator to operate in view of environmental conditions while avoiding at least part of the disadvantages associated with known solutions. According to embodiments of the present disclosure this further objective is addressed by an HVAC system having a 6-way flow regulator wherein the actuator is configured to control the 6-way flow regulator in the first operating mode and second operating mode in accordance with the valve control signal. In the first operating mode, controlling the orifice of the 6-way flow regulator enables: regulating the flow of fluid from the first fluid input towards the fluid output; and regulating the flow of fluid from the fluid return input towards the first fluid return output. In the second operating mode, controlling the orifice of the 6-way flow regulator enables regulating the flow of fluid from the second fluid input towards the fluid output; and regulating the flow of fluid from the fluid return input towards the second fluid return output.

The above-identified objectives are further addressed according to the present invention by a computer program product comprising instructions, which, when executed by a processor of a controller of an HVAC system comprising a thermal energy exchanger and a flow sensor cause the HVAC system to carry out the method of controlling a thermal power transfer of a thermal energy exchanger according to one of the embodiments disclosed herein.

It is to be understood that both the foregoing general description and the following detailed description present embodiments, and are intended to provide an overview or framework for understanding the nature and character of the disclosure. The accompanying drawings are included to provide a further understanding, and are incorporated into and constitute a part of this specification. The drawings illustrate various embodiments, and together with the description serve to explain the principles and operation of the concepts disclosed.

BRIEF DESCRIPTION OF THE DRAWINGS

The herein described disclosure will be more fully understood from the detailed description given herein below and the accompanying drawings which should not be considered limiting to the disclosure described in the appended claims. The drawings which show:

DETAILED DESCRIPTION

Reference will now be made in detail to certain embodiments, examples of which are illustrated in the accompanying drawings, in which some, but not all features are shown. Indeed, embodiments disclosed herein may be embodied in many different forms and should not be construed as limited to the embodiments set forth herein; rather, these embodiments are provided so that this disclosure will satisfy applicable legal requirements. Whenever possible, like reference numbers will be used to refer to like components or parts.

Figure 1:
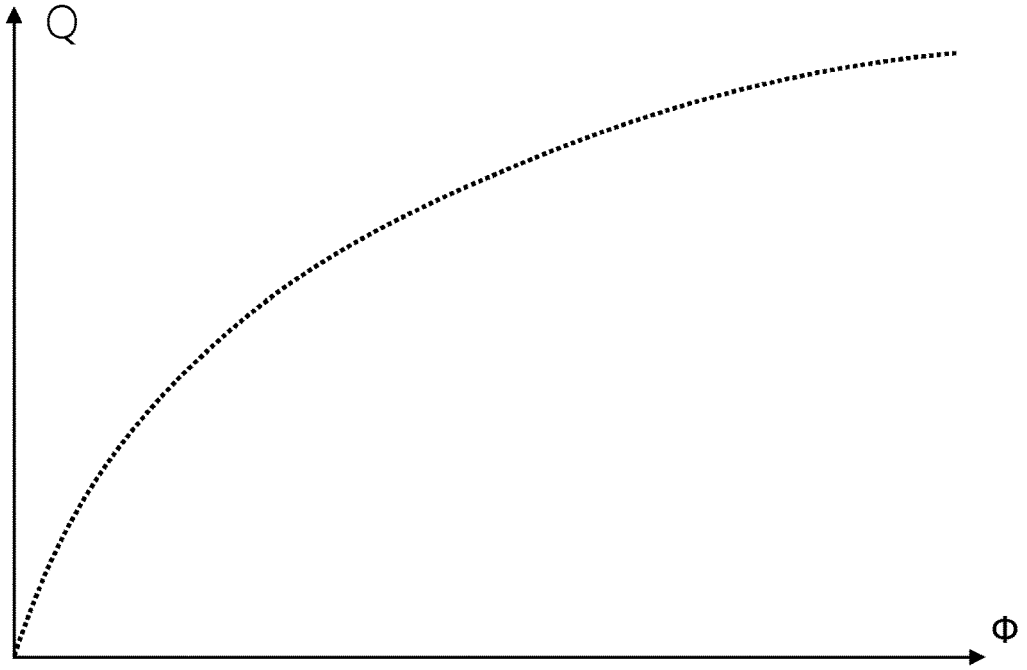
FIG. 1: an illustrative thermal power transfer characteristic curve of a common thermal energy exchanger.

FIG. 1 shows an illustrative thermal power transfer characteristic curve of a common thermal energy exchanger, showing the relationship between thermal power transfer Q and fluid flow rate $\phi$ in a particular scenario of operating conditions. Thermal energy transfer measured is shown on the y axis, and flow rate on the x-axis.

It can be seen that increasing the flow rate $\phi$ increases the thermal power transfer. However, the behavior is nonlinear. As the flow rate $\phi$ continues to increase, the commensurate increase in thermal power transfer Q steadily reduces. In fact, a levelling off can be seen such that at high flow rates $\phi$, increasing the flow rate $\phi$ further results in little increase in the thermal power transfer Q. The thermal energy exchanger 80 is said to be operating at saturation once the levelling off occurs. Saturation occurs when the thermal energy exchanger 80 has reached a state such that further increasing the flow rate $\phi$ does not result in significantly greater thermal power transfer Q. Depending on the embodiment, the point at which saturation occurs is defined differently. For instance, the saturation point SAT can be calculated as a percentage of the thermal power transferred by the thermal energy exchanger 80 at a maximum flow rate $\phi$.

Figure 2:
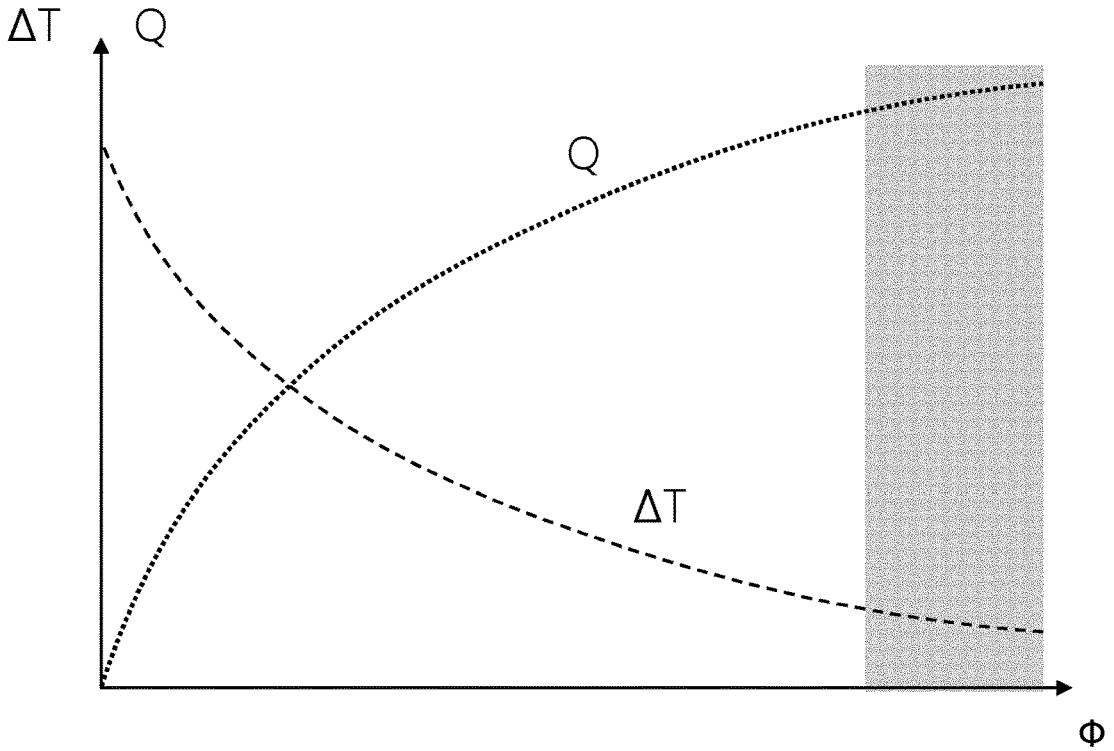
FIG. 2: an illustrative flow rate to delta-T mapping curve superimposed on a corresponding thermal power transfer characteristic curve of a common thermal energy exchanger.

FIG. 2 shows an illustrative flow rate to delta-T mapping curve (shown with a dashed line) superimposed on the corresponding thermal power transfer characteristic curve of a common thermal energy exchanger of FIG. 1. As it can be seen, as the thermal power transfer Q starts to level off at higher flow rates $\phi$ (as the thermal energy exchanger 80 approaches saturation—shown with a grey band of the X-axis), the temperature differential $\Delta T$ over the thermal energy exchanger 80 decreases and eventually approaches a level off.

Figure 3:
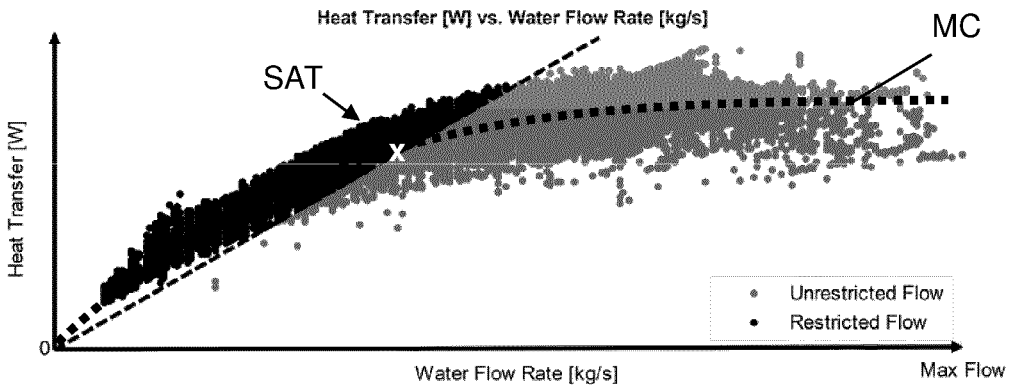
FIG. 3: a scatter plot showing relationships between thermal power transfer and fluid flow rate for multiple operating conditions of a thermal energy exchanger.

FIG. 3 shows a scatter plot of multitude of relationships between thermal energy transfer on the y axis, and water flow rate measured in kg/s on the x-axis for the thermal energy exchanger 80 and various operating conditions thereof. In particular, the thermal power transfer Q from a fluid W, specifically water, to a secondary fluid A, specifically air, through the thermal energy exchanger 80 is shown as a function of the current flow $\phi$, specifically the water flow rate, for multiple operating conditions of the thermal energy exchanger 80. Each dot on the scatter plot represents the thermal power transfer Q of the thermal energy exchanger 80 at particular operating conditions and water flow rate $\phi$. The mean curve MC shows an average response.

For illustrative purposes, in the scatter plot of FIG. 3 the saturation point SAT is defined as 85% of the maximum thermal power transferred for an average thermal energy exchanger 80 which has a response curve as defined by the mean curve MC (shown with a dotted line). It can further be seen that, by extending a line through the origin and the saturation point SAT lying on the mean curve MC, the dots of the top scatter plot are divided into two regimes corresponding to unrestricted flow, marked as black dots, and restricted flow, marked as grey dots. The saturation point SAT defines both the thermal power transfer Q and a corresponding water flow rate $\phi$ required to achieve such a thermal power transfer Q for a thermal energy exchanger 80 of an HVAC system a lying on the mean curve MC. This saturation point SAT can be used to control the thermal energy exchanger 80 of any HVAC system a.

Figure 4:
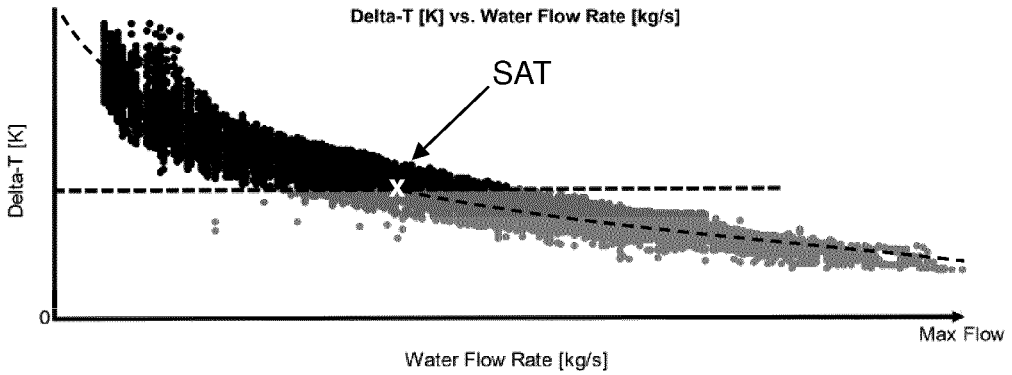
FIG. 4: a scatter plot showing an illustrative example of a flow rate to delta-T mapping, representative of relationships between delta-T and fluid flow rates for multiple operating conditions of a thermal energy exchanger.

FIG. 4 shows a scatter plot showing an illustrative example of a flow rate to delta-T mapping, representative of relationships between delta-T and fluid flow rates for multiple operating conditions of a thermal energy exchanger 80. The scatter plot of FIG. 4 is similar to the scatter plot of FIG. 3 in that it shows a plurality of measurement points of the heat exchanger 80 of HVAC systems a operating at different operating conditions and flow rates W. In the scatter plot of FIG. 4, however, delta-T in degrees Kelvin is plotted against flow rate W in kg/s, delta-T being the difference between the current supply temperature $T_{IN}$ of the fluid W, and the current return temperature $T_{out}$ of the fluid W. At low flow rates W, the fluid moves slowly enough through the thermal energy exchanger 80 that the difference between the current supply temperature $T_{in}$ and the current return temperature $T_{out}$ is large, as there is sufficient time for heat to transfer from the fluid W moving through the thermal energy exchanger 80. It can be seen in the scatter plot of FIG. 4 that as the flow rate W increases, delta-T decreases. This is because the fluid W remains in the thermal energy exchanger 80 for less time, allowing less heat to flow. The relationship is non-linear, such that for constant increases in the flow rate W, the commensurate decrease in delta-T grows ever smaller. The mean curve MC, representing the average relationship between delta-T and water flow rate is also plotted on the bottom scatter plot. Therefore, a saturation point SAT for the bottom scatter plot can also be defined as a minimum value of Delta-T (which also defines a maximum water flow rate), below which the thermal energy exchanger 80 is operating inefficiently. By using this definition of delta-T, which has, for example, a value of 10 degrees Kelvin, a given thermal energy exchanger 80 can be controlled such that the delta-T does not fall below the defined saturation point SAT. However, it can be seen that, for the plurality of operating conditions of the thermal energy exchanger 80 plotted on the bottom scatter plot, at some operating conditions comparatively little flow rate $\phi$ is required to achieve the minimum delta-T, while at other operating conditions require a very high water flow rate to achieve the same minimum delta-T as defined by the saturation point SAT. In the former cases the thermal energy exchanger 80 is operating efficiently, while in the latter cases the thermal energy exchanger 80 is no longer operating efficiently.

In general, little or no additional heat can be transferred by operating the thermal energy exchanger 80 above the saturation point SAT, the additional energy by the pump to drive the fluid through the pipes and the thermal energy exchanger 80 results in a lowered overall efficiency of the HVAC System 1.

Figure 5A:
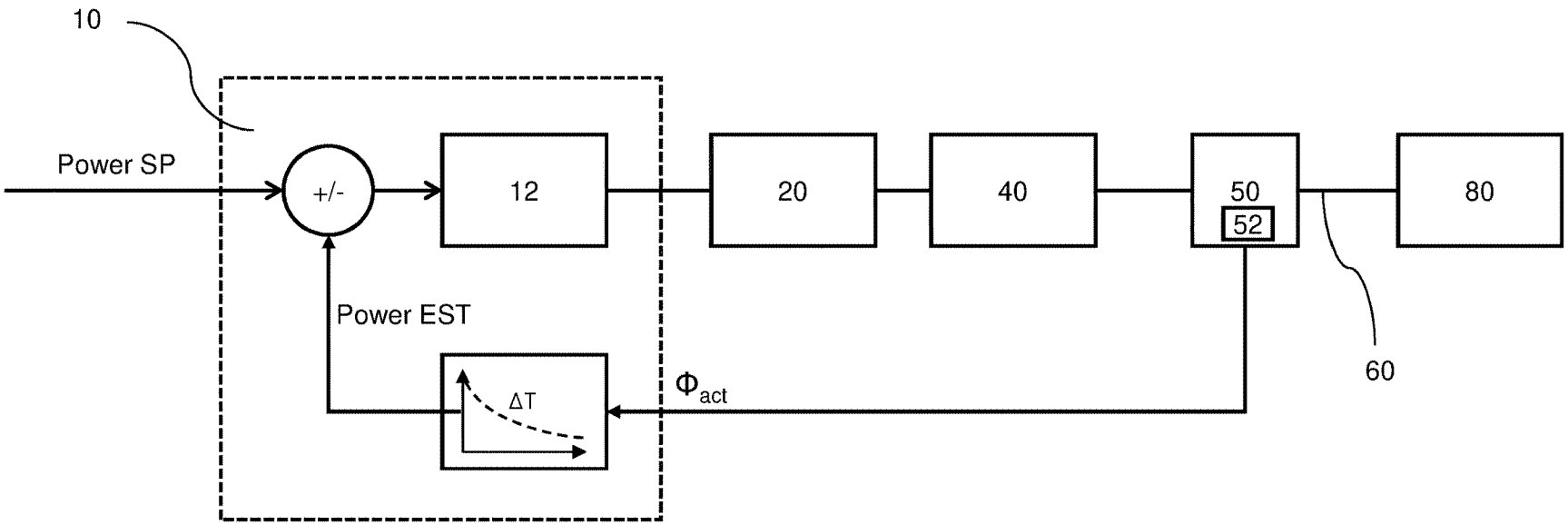
FIG. 5A: a highly schematic block diagram of an embodiment of an HVAC system according to the present invention.

Turning now to FIG. 5A, the HVAC system a according to a first embodiment of the present invention shall be described with reference to the highly schematic block diagram thereof. As illustrated, the HVAC system a comprises: a thermal energy exchanger 80; a valve 40 having an orifice; an actuator 20 mechanically coupled to the valve 40; a controller 10 communicatively connected to the actuator 20; a sensor module 50 comprising a flow sensor 52 configured for measuring a flow of fluid $\phi_{act}$ through the thermal energy exchanger 80 at a current position of the valve 40.

Figure 6:
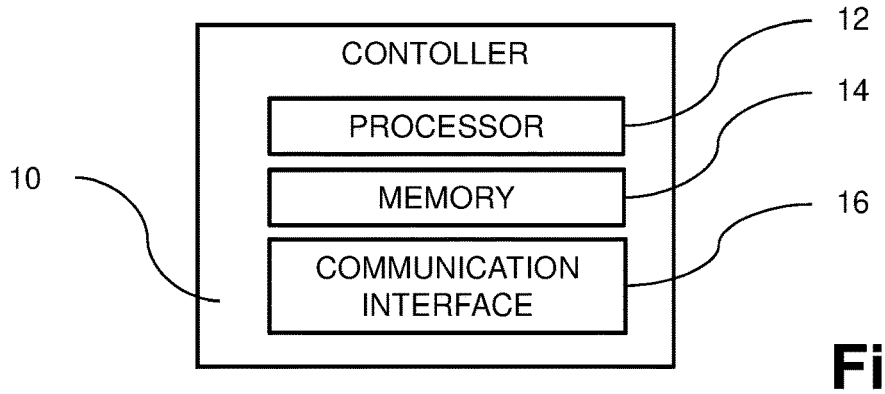
FIG. 6: a highly schematic block diagram of a controller, according to the present invention.

The controller 10 shall be described below in greater detail reference to FIG. 6 showing its structure and FIGS. 11 to 14 as to its functionality.

The thermal energy exchanger 80 is a device configured to transfer thermal energy between a fluid W to its environment, in particular by means of a secondary fluid A, e.g. air. Depending on the application and configuration, the thermal energy exchanger 80 comprises a heat exchanger or a chiller, for example. The secondary fluid A is air used for heating and/or cooling a building, in particular a room of the building. According to embodiments, the secondary fluid A may be driven through the thermal energy exchanger 80 by a fan. In an embodiment, the secondary fluid A moves through the thermal energy exchanger 80 passively, i.e. due to wind or convective forces. The thermal energy exchanger 80 provides energy to the secondary fluid A, if the temperature of the fluid W is greater than the temperature of the secondary fluid A and in this case acts as a heater. The thermal energy exchanger 80 draws energy from the secondary fluid A if the temperature of the fluid W is less than the temperature of the secondary fluid A and in this case acts as a cooler.

The valve 40 is a device for regulating the flow of fluid W by means of an orifice. Arranged between an energy source and a heat exchanger 80, the valve 40 is configured to regulate the flow of fluid W to and from heat exchanger 80.

The HVAC system a may further comprise a fluid transport system 60 for moving a (thermal transfer) fluid, for example a liquid, e.g. water and/or a refrigerant, or a gas, e.g. air, to and from the thermal energy exchanger 80. The fluid transport system 60 may comprise fluid transport lines (pipes or ducts), for conducting a flow of fluid through the thermal energy exchanger 80 and the valve 40.

Figure 5B:
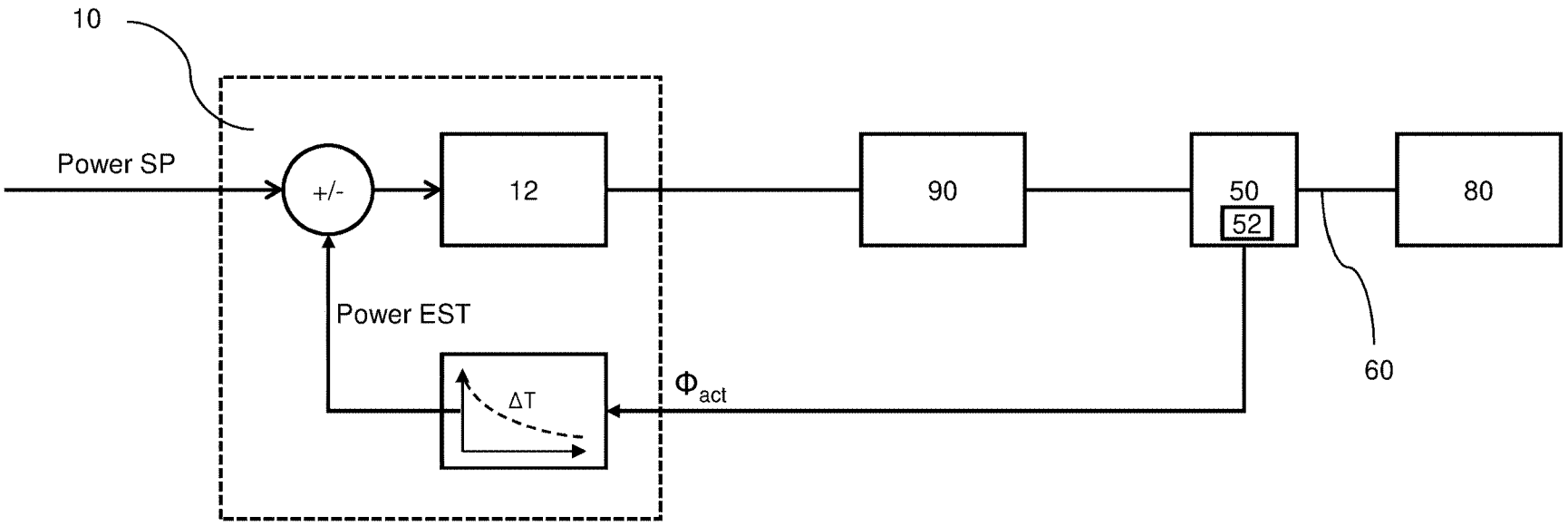
FIG. 5B: a highly schematic block diagram of a further embodiment of an HVAC system according to the present invention.

FIG. 5B shows a further embodiment of the HVAC system 1, comprising a pump go for driving and controlling the flow of the fluid W through the thermal energy exchanger 80. The fluid transport system 60 may be connected to an energy source, e.g. a heating device (furnace, heat pump) or a cooling device (chiller). Specifically, the fluid transport lines comprise a supply pipe (or duct), for feeding the fluid from the valve 40 to the thermal energy exchanger 80, and a return pipe (or duct), for returning the fluid from the thermal energy exchanger 80. The controller 10, in particular generation of pressure control signals for controlling the pump go, shall be described below in greater detail reference to FIG. 6 showing its structure and FIGS. 11 to 14 as to its functionality.

FIG. 6 shows a highly schematic block diagram of a controller 10 according to the present invention. The controller 10 comprises a processor 12, a memory for storing computer readable instructions and a communication interface 16 for receiving data signals (in particular the setpoint thermal power transfer (Power SP) and for transmitting data signal (in particular the control signal for controlling the orifice of the valve 40). The processor 14 may comprise a central processing unit (CPU) for executing computer program code stored in the memory. The processor 14, in an example, includes more specific processing units such as application specific integrated circuits (ASICs), reprogrammable processing units such as field programmable gate arrays (FPGAs), or processing units specifically configured to accelerate certain applications. The memory 14 comprises one or more volatile (transitory) and or non-volatile (non-transitory) storage components. The storage components are removable and/or non-removable, and are also integrated, in whole or in part with the controller 10. Examples of storage components include RAM (Random Access Memory), flash memory, hard disks, data memory, and/or other data stores. The memory 14 has stored thereon computer program code configured to control the processor 12 of the controller 10, such that the controller 10, more generally the HVAC system 1, performs one or more steps and/or functions as described herein. Depending on the embodiment, the computer program code is compiled or non-compiled program logic and/or machine code. As such, the controller 10 is configured to perform one or more steps and/or functions. The computer program code defines and/or is part of a discrete software application. One skilled in the art will understand, that the computer program code can also be distributed across a plurality of software applications. The software application is installed in the controller 10. Alternatively, the computer program code can also be retrieved and executed by the controller 10 on demand. In an embodiment, the computer program code further provides interfaces, such as APIs (Application Programming Interfaces), such that functionality and/or data of the controller 10 is accessed remotely, such as via a client application or via a web browser. In an embodiment, the computer program code is configured such that one or more steps and/or functions are not performed in the controller 10 but in the external computing device, for example the mobile phone, and/or a remote server at a different location to the controller 10, for example in the cloud-based computer system 10 (not shown).

Figure 7:
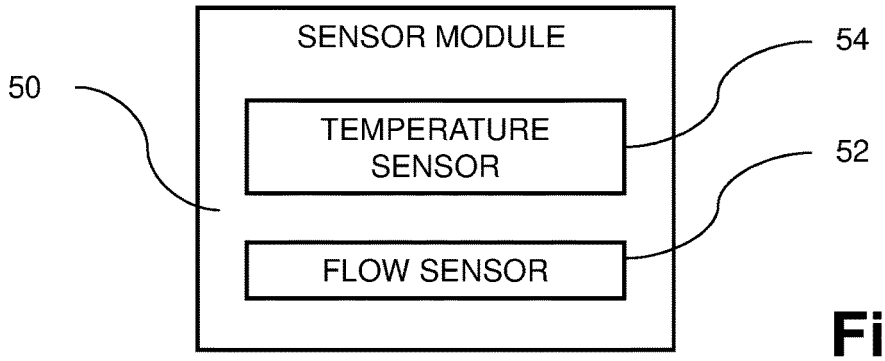
FIG. 7: a highly schematic block diagram of a sensor module, according to the present invention.

FIG. 7 shows a highly schematic block diagram of a sensor module 50 according to embodiments of the present invention, comprising a flow sensor 52 (such as an ultrasonic flow sensor) and a temperature sensor 54. The flow sensor 52 is configured and arranged between the valve 40 and the thermal energy exchanger 80 such as to measure a flow of fluid $\phi_{act}$ through the thermal energy exchanger 80 at a current position of the valve 40. The temperature sensor 54 is configured and arranged between the valve 40 and a fluid input side 82 of thermal energy exchanger 80 such as to a supply temperature $T_{IN}$ of the fluid W. Alternatively, the temperature sensor 54 is configured and arranged between the valve 40 and a fluid return side 84 of thermal energy exchanger 80 such as to a return temperature $T_{out}$ of the fluid W.

Figure 8:
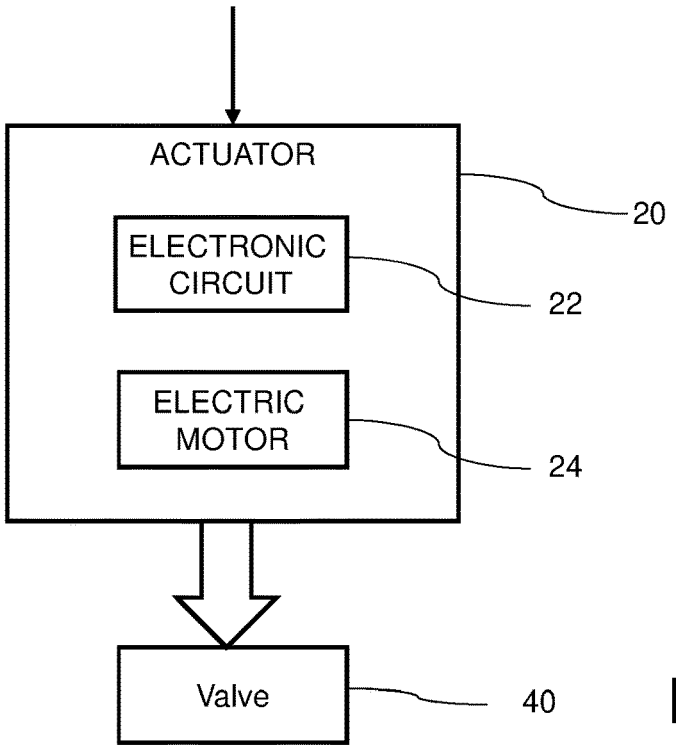
FIG. 8: a highly schematic block diagram of an actuator of an HVAC system according to the present disclosure.
Figure 9:
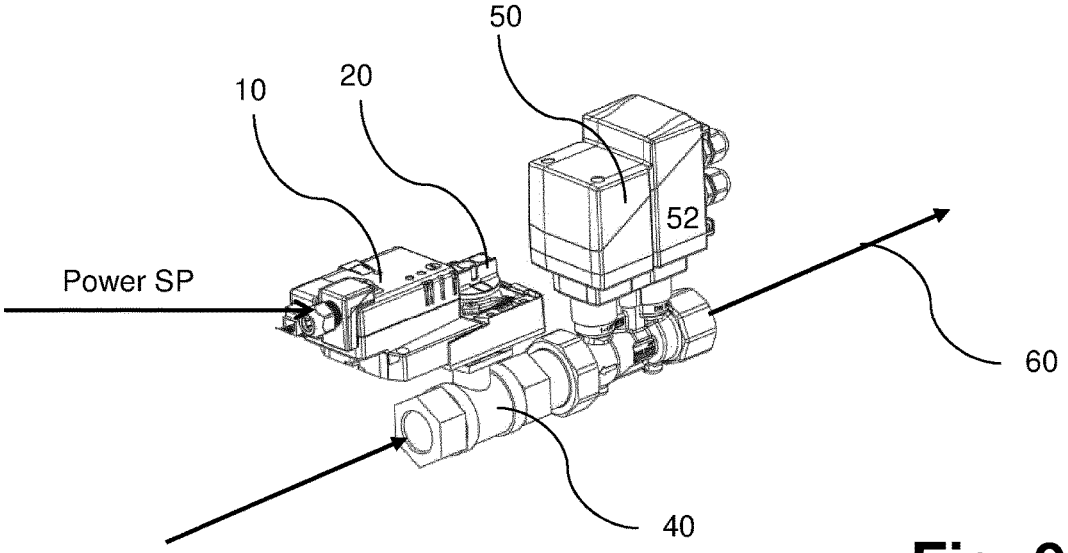
FIG. 9: an illustrative view of a controller connected to an actuator mechanically coupled to a valve, according to the present invention.

FIG. 8 shows a block diagram of an actuator 20 of an HVAC system 1 according to embodiments of the present disclosure. As illustrated, the actuator 20 comprises an electric motor 24 and an electronic circuit 22. The electric motor 24 is configured to move an actuated part, in particular the valve 40 coupled to the electric motor 24. The actuator 20 is configured to receive control signal(s) from the controller 10. The electronic circuit 22 is connected to the electric motor 24 and configured to control the electric motor 24 in accordance with the control signal(s).

Figure g shows an illustrative view of a controller 10 connected to an actuator 20 mechanically coupled to a valve 40 according to the present invention, the valve 40 being arranged to regulate the flow of fluid W through a fluid transport system 60.

Figure 10:
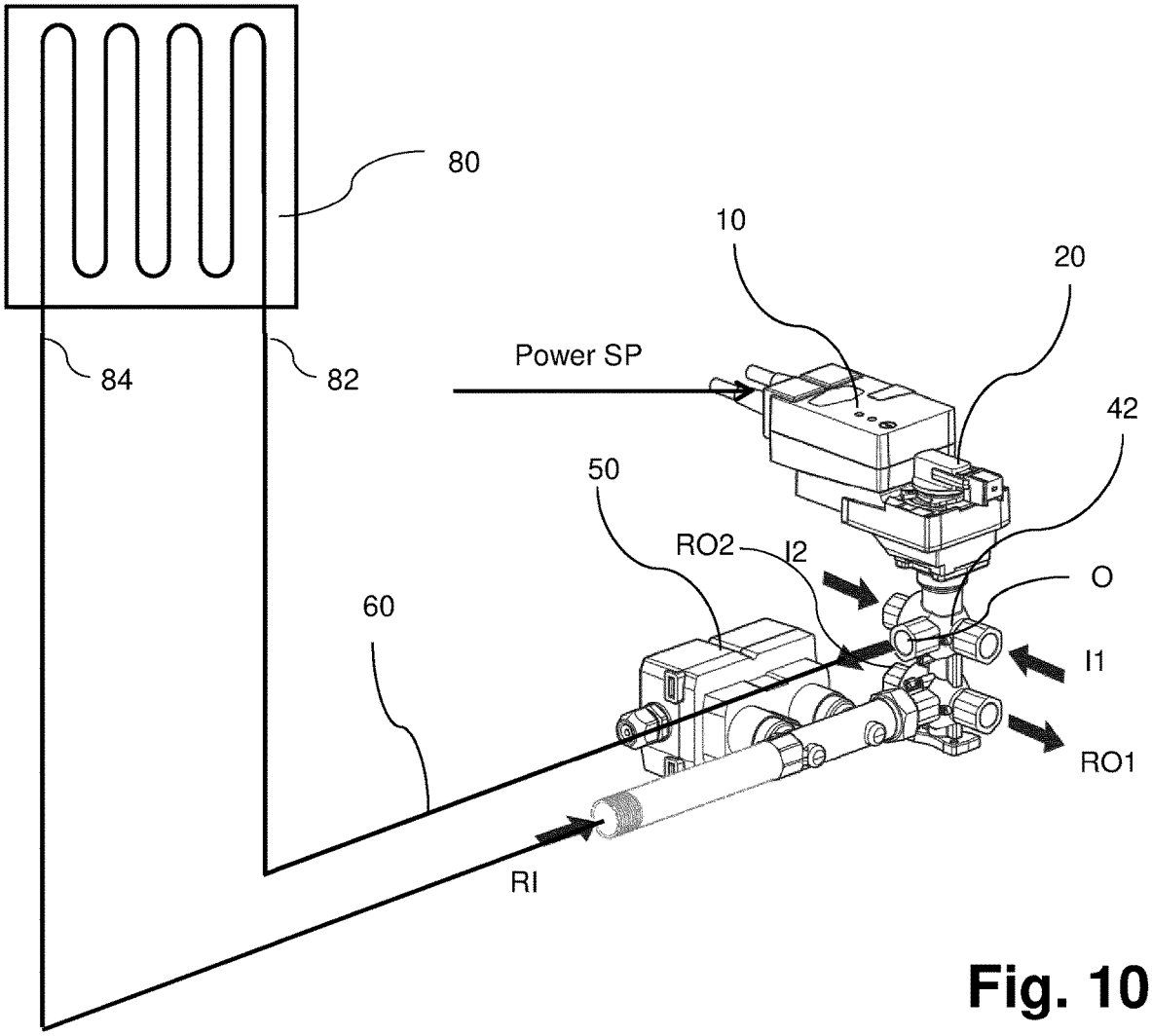
FIG. 10: an illustrative view of a controller connected to an actuator mechanically coupled to a valve comprising a 6-way flow regulator, according to the present invention.

FIG. 10 shows an illustrative view of a controller 10 connected to an actuator 20 mechanically coupled to a valve 40 comprising a 6-way flow regulator 42. The 6-way flow regulator 42 is capable of switching between a first mode of operation (heating, e.g. at a 90° position of the valve) and a second mode of operation (cooling, e.g. at a 0° position of the valve) based on control signals from the controller 10. As illustrated, the 6-way flow regulator 42 comprises a first fluid input I1; a second fluid input I2; a fluid output O; a fluid return input RI; a first fluid return output RO1; and a second fluid return output RO2. The 6-way flow regulator 42 may be operated in a first operating mode, a second operating mode and a third operating mode. In the first operating mode, the 6-way flow regulator 42 enables a flow of fluid from the first fluid input I1 towards the fluid output O and a flow of fluid from the fluid return input RI towards the first fluid return output RO1. In the second operating mode, the 6-way flow regulator 42 enables a flow of fluid from the second fluid input I2 towards the fluid output O and a flow of fluid from the fluid return input RI towards the second fluid return output RO2. In the third operating mode, the 6-way flow regulator 42 prevents passage of fluid between any of the first fluid input I1; the second fluid input(I2); the fluid output O; the fluid return input RI; the first fluid return output RO1 and the second fluid return output RO2. In order for the same heat exchanger 80 to be used for both heating and cooling, a fluid input side 82 of the heat exchanger 80 is fluidly connected to the fluid output O of the 6-way flow regulator 42 and a fluid return side 84 fluidly connected to the fluid return input RI of the 6-way flow regulator 42. The first fluid input I1 of the 6-way flow regulator 42 is fluidly connected to a fluid source of a first temperature and the second fluid input I2 of the 6-way flow regulator 42 is fluidly connected to a fluid source of a second temperature, the first temperature being different from the second temperature.

In the following paragraphs, described with reference to FIGS. 11 to 14, are sequences of steps performed for controlling the orifice (opening or position) of the valve 40 to regulate the flow $\phi W$ of fluid W through the thermal energy exchanger 80 of the HVAC system a and thereby adjust the thermal power transfer by the thermal energy exchanger 80, according to embodiments of the present disclosure.

Figure 11:
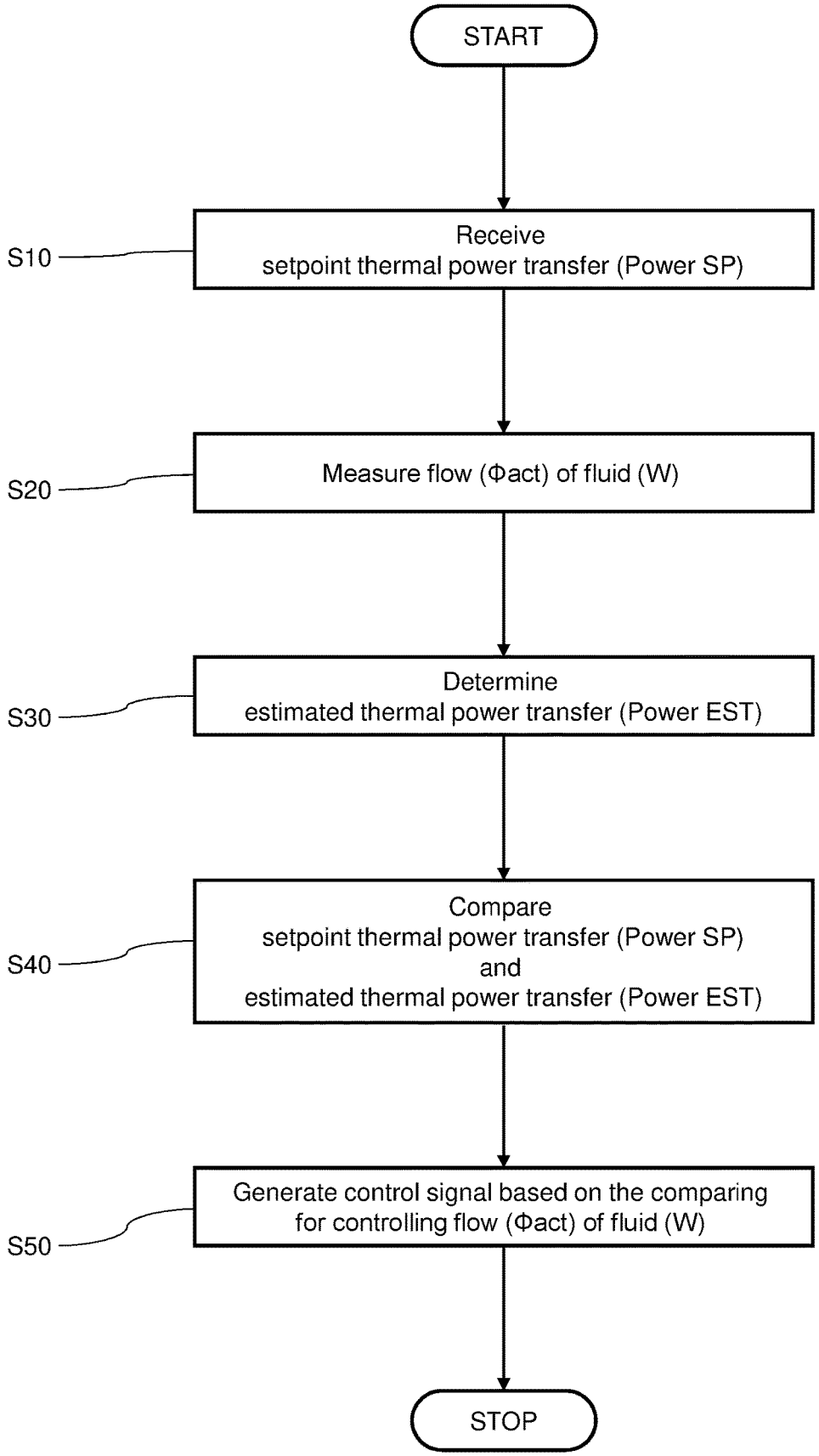
FIG. 11: a simplified flowchart of a first embodiment of a method of controlling an orifice of a valve in an HVAC system, according to the present invention.

FIG. 11 shows a simplified flowchart of a first embodiment of a method of controlling a thermal power transfer of a thermal energy exchanger 80 in an HVAC system a according to the present invention. In a first step S10 of the method according to the present invention, a setpoint thermal power transfer Power SP is received by the controller 10. According to embodiments of the present disclosure, the setpoint thermal power transfer Power SP may be a constant value or a variable function.

In a further—subsequent or simultaneous step S20, a flow of fluid $\phi_{act}$ through the thermal energy exchanger 80 is measured by a flow sensor 52.

In a step S30, using the measured flow of fluid $\phi_{act}$, the controller 10 determines an estimated thermal power transfer Power EST based on a defined flow rate to delta-T mapping. According to embodiments of the present disclosure, step S30 comprises determining, by the controller 10, an estimated temperature differential $\Delta T$ over the thermal energy exchanger 80 based on the measured flow $\phi_{act}$ of the fluid W, wherein the controller 10 determines the estimated thermal power transfer Power EST based on the measured flow of fluid $\phi_{act}$ and the estimated temperature differential $\Delta T$.

Having determined the estimated thermal power transfer Power EST, in a step S40, the controller 10 compares the setpoint thermal power transfer Power SP and the estimated thermal power transfer Power EST.

In a subsequent step S50, the controller 10 controls the flow $\phi_{act}$ of fluid W by generating a control signal based on the comparing. According to embodiments disclosed herein, the controller 10 controls the flow $\phi_{act}$ of fluid W by generating a control signal based on the comparing such as to minimize the difference between the setpoint thermal power transfer Power SP and the estimated thermal power transfer Power EST.

Figure 12:
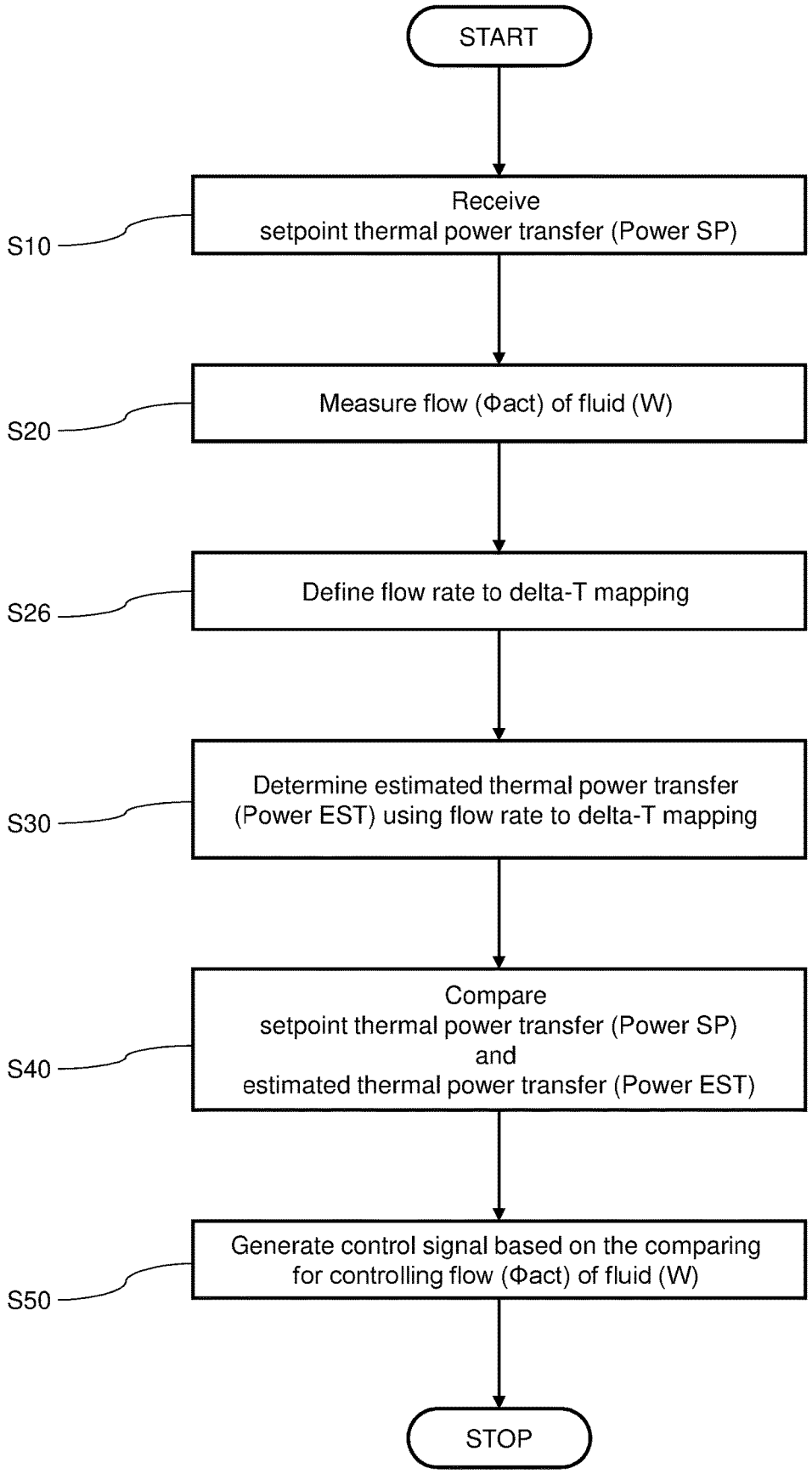
FIG. 12: a simplified flowchart of a further embodiment of a method of controlling an orifice of a valve in an HVAC system, according to the present invention.

FIG. 12 shows a simplified flowchart of a further embodiment of a method of controlling a thermal power transfer of a thermal energy exchanger 80 in an HVAC system 1, further comprising step S26 of defining the flow rate to delta-T mapping as a relation between a flow rate of fluid W through the thermal energy exchanger 80 and a temperature differential $\Delta T$ over the thermal energy exchanger 80.

According to embodiments of the present disclosure, the flow rate to delta-T mapping is defined based on calculations, and/or mathematical models and/or measurements of flow rates and temperature differentials over thermal energy exchangers.

Figure 13:
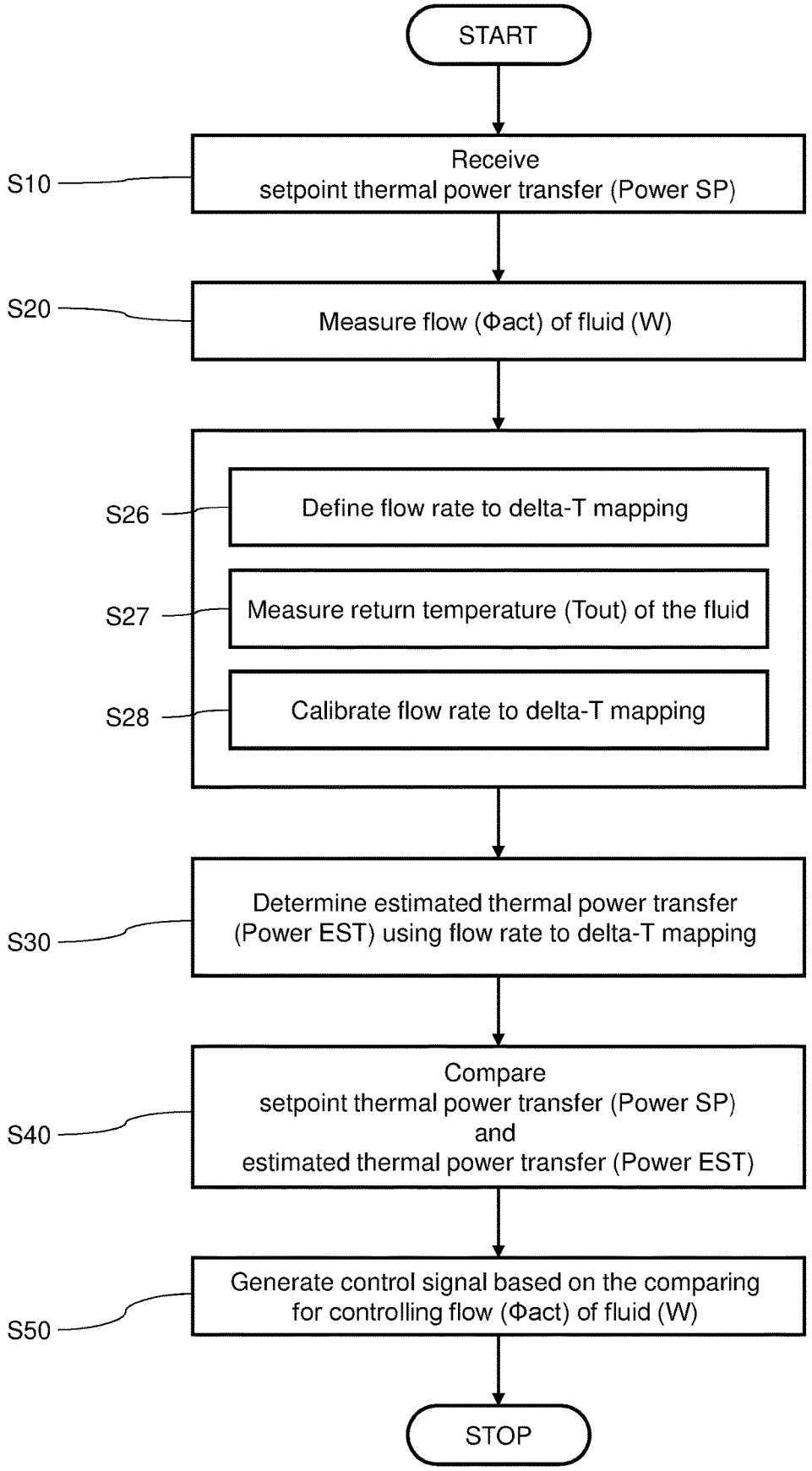
FIG. 13: a simplified flowchart of a further embodiment of a method of controlling an orifice of a valve in an HVAC system, according to the present invention.

FIG. 13 shows a simplified flowchart of an even further embodiment of a method of controlling a thermal power transfer of a thermal energy exchanger 80 in an HVAC system 1. In a step S27, a return temperature $T_{out}$ of the fluid W is measured by a temperature sensor 54.

Thereafter, in a step S28, the flow rate to delta-T mapping is calibrated using the measured return temperature $T_{IN}$ of the fluid W.

Figure 14:
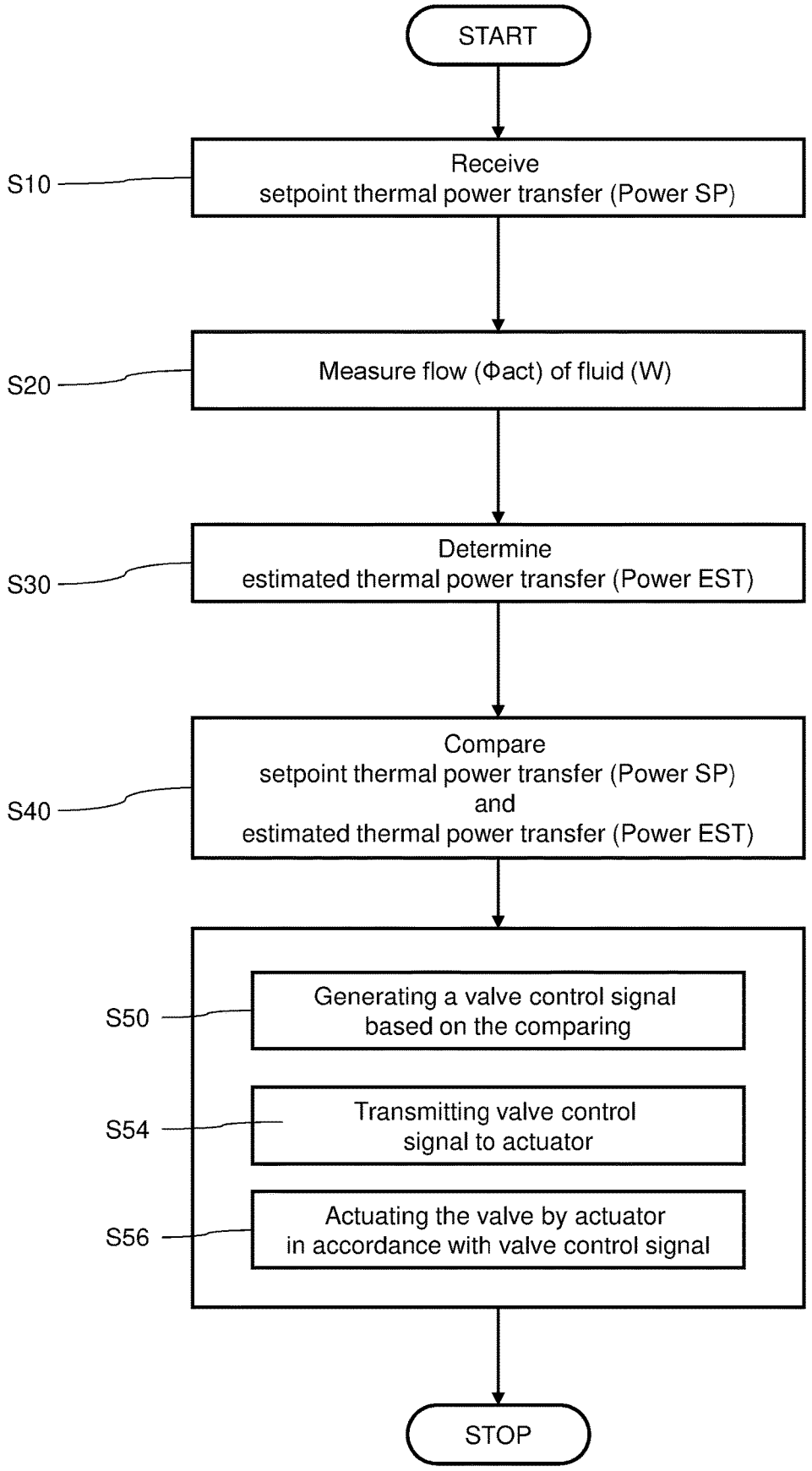
FIG. 14: a simplified flowchart of a further embodiment of a method of controlling an orifice of a valve in an HVAC system, according to the present invention.

FIG. 14 shows a simplified flowchart of embodiment(s) of a method of controlling an orifice of a valve 40 in an HVAC system a, wherein regulating the flow $\phi_{act}$ of the fluid W through the thermal energy exchanger 80 comprises generating a valve control signal for controlling an orifice of a valve 40 of the HVAC system a. In a step S54 following step S50, the valve control signal is transmitted, by the controller 10, to the actuator 20. Thereafter, in a step S56 the valve is actuated, by the actuator 20, in accordance with the valve control signal such as to control the orifice of the valve 40.

LIST OF REFERENCE NUMERALS power transfer Q
flow of fluid $\phi$
measured flow of fluid $\phi_{act}$
temperature differential $\Delta T$
supply temperature $T_{IN}$
return temperature $T_{out}$
setpoint thermal power transfer Power SP
estimated thermal power transfer Power EST
controller 10
processor (of controller) 12
memory (of controller) 14
communication interface (of controller) 16
actuator 20 electronic circuit (of actuator) 22
electric motor (of actuator) 24
valve 40
6-way flow regulator 42
a first fluid input (of 6-way flow regulator) I1
a second fluid input (of 6-way flow regulator) I2
a fluid output (of 6-way flow regulator) O
a fluid return input (of 6-way flow regulator) RI
a first fluid return output (of 6-way flow regulator) RO1.
a second fluid return output (of 6-way flow regulator) RO2
sensor module 50
flow sensor 52
temperature sensor 54
fluid transport system 60
thermal energy exchanger 80
fluid input side (of heat exchanger) 82
fluid return side (of heat exchanger) 84
pump 90
saturation point SAT

The invention claimed is:

1. A method of controlling a thermal power transfer of a thermal energy exchanger of an HVAC system, the method comprising:

receiving, by a controller, a setpoint thermal power transfer;

measuring, by a flow sensor, a measured flow of a fluid through the thermal energy exchanger;

determining, by the controller, an estimated thermal power transfer, using the measured flow of fluid and a defined flow rate to delta-T mapping, the estimated thermal power transfer being determined without using a supply temperature or a return temperature of the fluid measured by a temperature sensor;

comparing, by the controller, the setpoint thermal power transfer and the estimated thermal power transfer; and regulating, by the controller, the flow of the fluid through the thermal energy exchanger based on the comparing.

2. The method of claim 1, wherein regulating the flow of the fluid through the thermal energy exchanger comprises generating, by the controller, based on the comparing, a valve control signal for controlling an orifice of a valve of the HVAC system; and wherein the flow of the fluid is measured by the flow sensor at a current position of the valve.

3. The method according to claim 2, further comprising:

transmitting, by the controller, the valve control signal to an actuator mechanically coupled to the valve; and actuating the valve, by the actuator, in accordance with the valve control signal.

4. The method of claim 1, wherein:

regulating the flow of the fluid through the thermal energy exchanger comprises generating, by the controller, based on the comparing, a pressure control signal for controlling a supply pressure of the fluid; and the flow of the fluid is measured by the flow sensor at a current supply pressure of the fluid.

5. The method according to claim 1, further comprising defining the flow rate to delta-T mapping as a relation between a flow rate of fluid through the thermal energy exchanger and a temperature differential of the fluid over the thermal energy exchanger.

6. The method according to claim 1, wherein the fluid is a primary fluid, and the flow rate to delta-T mapping is defined based on one or more of:

a thermal energy transfer characteristic curve of the thermal energy exchanger;

a heat transfer coefficient of the thermal energy exchanger;

a thermal conductivity of the thermal energy exchanger;

a flow and/or temperature of a secondary fluid through and/or around the thermal energy exchanger;

a convection heat transfer coefficient of the primary fluid;

a current operation mode of the thermal energy exchanger;

a thermal energy exchanger type of the thermal energy exchanger; and geometric data of the thermal energy exchanger.

7. The method according to claim 1, further comprising determining, by the controller, an estimated temperature differential of the fluid over the thermal energy exchanger based on the measured flow of the fluid, wherein the controller determines the estimated thermal power transfer based on the measured flow of fluid and the estimated temperature differential.

8. The method according to claim 1, further comprising:

measuring by a temperature sensor or receiving data indicative of:

a supply temperature of the fluid;

a return temperature of the fluid; or a temperature of a secondary fluid through and/or around the thermal energy exchanger, and calibrating said flow rate to delta-T mapping using:

the supply temperature based on the data being indicative of the supply temperature, the return temperature of the fluid based on the data being indicative of the return temperature, or the temperature of the secondary fluid based on the data being indicative of the temperature of the secondary fluid.

9. A controller for controlling a thermal power transfer of a thermal energy exchanger of an HVAC system, the controller comprising a processor configured to carry out the method according to claim 1.

10. A non-transitory computer readable storage medium comprising instructions, which, when executed by a processor of a controller of an HVAC system comprising a thermal energy exchanger and a flow sensor, cause the processor to carry out the method according to claim 1.

11. The method of claim 1, wherein the estimated thermal power transfer is determined only using the measured flow of fluid and the defined flow rate to delta-T mapping.

12. An HVAC system comprising:

a thermal energy exchanger;

a controller; and a flow sensor configured to measure a flow of fluid through the thermal energy exchanger;

wherein the controller is configured to:

determine an estimated thermal power transfer, using the measured flow of fluid and a defined flow rate to delta-T mapping, the estimated thermal power transfer being determined without using a supply temperature or a return temperature of the fluid measured by a temperature sensor; and generate a control signal for regulating the flow of the fluid through the thermal energy exchanger based on the determining.

13. The HVAC system according to claim 12, further comprising:

a valve having an orifice; and an actuator mechanically coupled to the valve, wherein the control signal, generated by the controller, comprises a valve control signal for controlling an orifice of the valve of the HVAC system, wherein the controller is further configured to transmit the valve control signal to the actuator, and wherein the actuator is configured to actuate the valve controlling the orifice such as to regulate the flow of a fluid through a thermal energy exchanger in accordance with the valve control signal.

14. The HVAC system according to claim 13, wherein the valve comprises a 6-way flow regulator comprising:

a first fluid input;

a second fluid input;

a fluid output fluidly connected to a fluid input side of the thermal energy exchanger;

a fluid return input fluidly connected to a fluid return side of the thermal energy exchanger;

a first fluid return output; and a second fluid return output, wherein the actuator is configured to control the 6-way flow regulator in the first operating mode and second operating mode in accordance with the valve control signal:

wherein, in the first operating mode, controlling the orifice of the 6-way flow regulator enables:

regulating the flow (Φ) of fluid (W) from the first fluid input ($I_1$) towards the fluid output (O); and regulating the flow (Φ) of fluid (W) from the fluid return input (RI) towards the first fluid return output ($RO_1$), and wherein, in the second operating mode, controlling the orifice of the 6-way flow regulator enables:

regulating the flow of fluid from the second fluid input towards the fluid output; and regulating the flow of fluid from the fluid return input towards the second fluid return output.

15. The HVAC system according to claim 12, further comprising a pump that drives the fluid through the thermal energy exchanger, wherein the control signal, generated by the controller, comprises a pressure control signal for controlling a supply pressure of the fluid, wherein the controller is further configured to transmit the pressure control signal to the pump, and wherein the pump is configured drive the fluid through the thermal energy exchanger at a supply pressure in accordance with the pressure control signal.

16. The HVAC system according to claim 12, wherein the controller determines the estimated thermal power transfer only using the measured flow of fluid and the defined flow rate to delta-T mapping.

* * * * *